US008545574B2

(12) United States Patent
Vinson et al.

(10) Patent No.: US 8,545,574 B2
(45) Date of Patent: Oct. 1, 2013

(54) METHODS FOR TREATING FIBROUS STRUCTURES

(75) Inventors: Kenneth Douglas Vinson, Cincinnati, OH (US); Jonathan Andrew Ficke, Lawrenceburg, IN (US); Khosrow Pariz Mohammadi, West Chester, OH (US); Robert Michael Bourbon, Cincinnati, OH (US); Paul Joseph Coffaro, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1453 days.

(21) Appl. No.: 10/462,965

(22) Filed: Jun. 17, 2003

(65) Prior Publication Data

US 2004/0255396 A1 Dec. 23, 2004

(51) Int. Cl.

| | |
|---|---|
| ***D21H 23/22*** | (2006.01) |
| ***D21H 23/38*** | (2006.01) |
| ***D21H 23/48*** | (2006.01) |
| ***D21F 9/04*** | (2006.01) |
| ***D21F 11/00*** | (2006.01) |
| ***D21F 11/06*** | (2006.01) |

(52) U.S. Cl.
USPC ..... 8/115.51; 8/116.1; 8/188; 8/528; 162/118; 162/119

(58) Field of Classification Search
USPC ..... 162/111–184; 264/282–283; 428/211; 604/358; 8/115.51, 116.1, 188, 528
See application file for complete search history.

(56) References Cited

U.S. PATENT DOCUMENTS

| | | | | |
|---|---|---|---|---|
| 4,539,063 | A * | 9/1985 | Cue et al. | 156/361 |
| 4,985,399 | A * | 1/1991 | Matsuda et al. | 503/227 |
| 5,002,800 | A | 3/1991 | Uehara et al. | |
| 5,164,046 | A | 11/1992 | Ampulski et al. | |
| 5,215,626 | A | 6/1993 | Ampulski et al. | |
| 5,246,545 | A * | 9/1993 | Ampulski et al. | 162/112 |
| 5,246,546 | A | 9/1993 | Ampulski | |
| 5,385,643 | A | 1/1995 | Ampulski | |
| 5,386,712 | A * | 2/1995 | Haselwander | 68/203 |
| 5,389,204 | A | 2/1995 | Ampulski | |
| 5,392,059 | A * | 2/1995 | Ueno et al. | 347/188 |
| 5,525,345 | A | 6/1996 | Warner et al. | |
| 5,622,599 | A | 4/1997 | Sproule et al. | |
| 5,648,425 | A * | 7/1997 | Everaerts et al. | 525/100 |
| 5,716,692 | A | 2/1998 | Warner et al. | |
| 5,747,107 | A * | 5/1998 | Bayer et al. | 427/208.4 |
| 5,997,646 | A | 12/1999 | Madrzak et al. | |
| 6,004,394 | A | 12/1999 | Gottwald | |
| 6,010,739 | A | 1/2000 | Ueberschar et al. | |
| 6,022,591 | A | 2/2000 | Ueberschar et al. | |
| 6,053,978 | A | 4/2000 | Bernert | |
| 6,053,979 | A | 4/2000 | Bernert et al. | |
| 6,063,193 | A | 5/2000 | Hess et al. | |

(Continued)

FOREIGN PATENT DOCUMENTS

| | | |
|---|---|---|
| EP | 0 770 730 B1 | 12/2001 |
| WO | WO 98/29602 | 7/1998 |

(Continued)

*Primary Examiner* — Tri V Nguyen
(74) *Attorney, Agent, or Firm* — Wednesday G. Shipp; C. Brant Cook

(57) ABSTRACT

Methods for treating a fibrous structure in need of treatment with a chemical additive, such as a chemical softener, and products produced therefrom, are provided.

27 Claims, 8 Drawing Sheets

(56) References Cited

U.S. PATENT DOCUMENTS

| | | | | |
|---|---|---|---|---|
| 6,063,450 | A | 5/2000 | Bernert et al. | |
| 6,093,248 | A | 7/2000 | Kohl et al. | |
| 6,126,751 | A | 10/2000 | Bernert et al. | |
| 6,126,784 | A * | 10/2000 | Ficke et al. | 162/184 |
| 6,132,807 | A | 10/2000 | Hess et al. | |
| 6,187,142 | B1 | 2/2001 | Heinzmann et al. | |
| 6,197,154 | B1 * | 3/2001 | Chen et al. | 162/109 |
| 6,277,197 | B1 | 8/2001 | Gottwald | |
| 6,406,752 | B1 | 6/2002 | Vinson | |
| 6,409,836 | B1 | 6/2002 | Bernert et al. | |
| 6,416,580 | B1 | 7/2002 | Kohl et al. | |
| 6,416,797 | B1 | 7/2002 | Han et al. | |
| 6,428,794 | B1 | 8/2002 | Klofta et al. | |
| 6,464,758 | B1 | 10/2002 | Hoferer | |
| 6,468,588 | B1 | 10/2002 | Bernert et al. | |
| 6,475,281 | B1 | 11/2002 | Bernert | |
| 6,494,954 | B1 | 12/2002 | Bernert et al. | |
| 6,547,926 | B2 * | 4/2003 | Drew et al. | 162/113 |
| 6,579,368 | B1 | 6/2003 | Kohl et al. | |
| 6,602,554 | B1 | 8/2003 | Kwok | |
| 6,716,309 | B2 | 4/2004 | Chuang et al. | |
| 6,730,165 | B2 | 5/2004 | Emery et al. | |
| 6,949,166 | B2 * | 9/2005 | Bakken et al. | 162/123 |
| 2002/0152630 | A1 * | 10/2002 | Lindsay et al. | 34/111 |
| 2002/0166646 | A1 * | 11/2002 | Drew et al. | 162/111 |
| 2003/0118848 | A1 * | 6/2003 | Liu | 428/447 |
| 2004/0175556 | A1 * | 9/2004 | Clark et al. | 428/298.4 |
| 2004/0238135 | A1 * | 12/2004 | Edwards et al. | 162/111 |

FOREIGN PATENT DOCUMENTS

| | | | |
|---|---|---|---|
| WO | WO 00/50217 | A1 | 8/2000 |
| WO | WO 03/057988 | A1 | 7/2003 |
| WO | WO 03/084681 | | 10/2003 |
| WO | WO 03/102300 | | 12/2003 |

* cited by examiner

METHODS FOR TREATING FIBROUS STRUCTURES

FIELD OF THE INVENTION

The present invention relates to methods for treating a fibrous structure in need of treatment with a treating composition comprising a chemical additive, such as a chemical softener, and products produced therefrom.

BACKGROUND OF THE INVENTION

Softness of sanitary tissue, such as facial tissue and/or toilet tissue, and fibrous structures incorporated therein is of paramount importance. The purpose of being soft is so that these products can be used to cleanse the skin without being irritating. Making soft tissue products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area, which has received a considerable amount of attention, is the addition of chemical softening agents (also referred to herein as "chemical softeners") to sanitary tissue products.

Because of the well known negative side effects associated with adding chemical softening agents to the wet end of the papermaking process, the addition of chemical softeners to a tissue paper fibrous structure (web) after the fibrous structure is dewatered, usually after it is partially or entirely dried, has received attention.

Many of these problems would be overcome if one could use a simple system to spray a functional additive directly onto the surface of the dried paper web just prior to winding. However, there are a number of problems associated with the use of spray systems for applying functional additives to a web and it has not been possible to obtain an even, complete coverage of functional additives onto a paper web at machine speeds. Traditionally, in the printing and writing paper and packaging paper industries, coating material is sprayed by pressure type nozzles, which employ the fluid pressure to disperse the fluid, creating large droplets of liquid, resulting in spotty coverage of the web. Typical spray systems used in the industry propel the fluid at a high velocity, generating sufficient force to cause a ricochet effect when the fluid impacts on the web resulting in a spotty uneven finish. With typical high pressure application, the center of the stream is more concentrated causing streaks on the coated surface while the outer edges of the spray fan are lost to the atmosphere, with a typical transfer efficiency of less than 50%. The outer edges of the fan may also dry before reaching the substrate, contributing to the poor transfer efficiency. The poor transfer efficiency may also contribute to equipment contamination as overspray is carried in the air, mixes with dust released from the paper web and the resulting mixture deposits on any surface that it may come into contact with, thereby contaminating the equipment and work environment.

In the case of the combination of a delicate web and a high viscosity additive, such as between about 50 cP and about 5000 cP, the needs for hygiene are particularly enhanced owing to the mixture of dust and functional additive elevating the hygiene impacts to a new level. The mixture of dust and functional additive is immediately apparent in any attempts to use conventional spray technology directly onto a dry, delicate web. The mixture of dust and functional additive is easily formed and has a marked impact on the reliability of the operation. Researchers use the term "kgnarr" to refer to this contaminant formed when a functional chemical additive unites with the dust in the surroundings of the traveling web in an additive-application area. Elimination of kgnarr is essential to achieving a reliable application of a functional chemical additive onto a delicate fibrous structure during the papermaking process.

Accordingly, there is a need for a simple, flexible and efficient method for applying a chemical additive, such as a chemical softener, to a fibrous structure (web) while the fibrous structure is moving, typically at a high speed e.g., greater than about 100 m/min, without the creation of kgnarr.

SUMMARY OF THE INVENTION

The present invention fulfills the needs described above by providing methods for treating a fibrous structure with a treating composition comprising a chemical additive.

In one aspect of the present invention, a method for treating a fibrous structure in need of treatment, the method comprising the steps of:

a. providing a transfer surface comprising a treating composition comprising a chemical additive, wherein the treating composition is releasably associated with the transfer surface;
b. providing a fibrous structure;
c. contacting the fibrous structure with the transfer surface such that the chemical additive is transferred to the fibrous structure, wherein a speed differential exists between the transfer surface and the fibrous structure, such that the fibrous structure is treated, is provided.

In another aspect of the present invention, a method for treating a fibrous structure in need of treatment, the method comprising the steps of:

a. providing a treating composition comprising a chemical additive, wherein the treating composition has a viscosity of between about 50 cP and about 5000 cP;
b. providing a fibrous structure in need of treatment;
c. providing an applicator through which the treating composition can be delivered to the fibrous structure;
d. providing the applicator comprising a discharge surface;
e. maintaining the discharge surface of the application in contact with the fibrous structure for a distance greater than about 10 cm; and
f. delivering the chemical additive via the discharge surface of the applicator to the fibrous structure such that the fibrous structure is treated, is provided.

In another aspect of the present invention, a method for treating a fibrous structure in need of treatment, the method comprising the steps of:

a. providing a treating composition comprising a chemical additive, wherein the treating composition has a viscosity of less than 5000 cP;
b. providing a fibrous structure having a lint value greater than about 2, wherein the fibrous structure is in need of treatment;
c. providing an applicator through which the treating composition can be delivered to the fibrous structure, wherein the applicator comprises at least one nozzle, preferably a plurality of nozzles, wherein the at least one nozzle comprises a liquid exit orifice terminating at a separation distance of less than about 20 cm from the fibrous structure; and
d. discharging the chemical additive through the nozzle such that the fibrous structure is treated, is provided.

In yet another aspect of the present invention, a fibrous structure made by a method in accordance with the present invention, is provided.

In still another aspect of the present invention, a single- or multi-ply sanitary tissue comprising a fibrous structure in accordance with the present invention, is provided.

Accordingly, the present invention provides methods for treating fibrous structures with a chemical additive, fibrous structures made therefrom, and sanitary tissue products made therefrom.

DETAILED DESCRIPTION OF THE INVENTION

Sanitary Tissue

Figure 1:
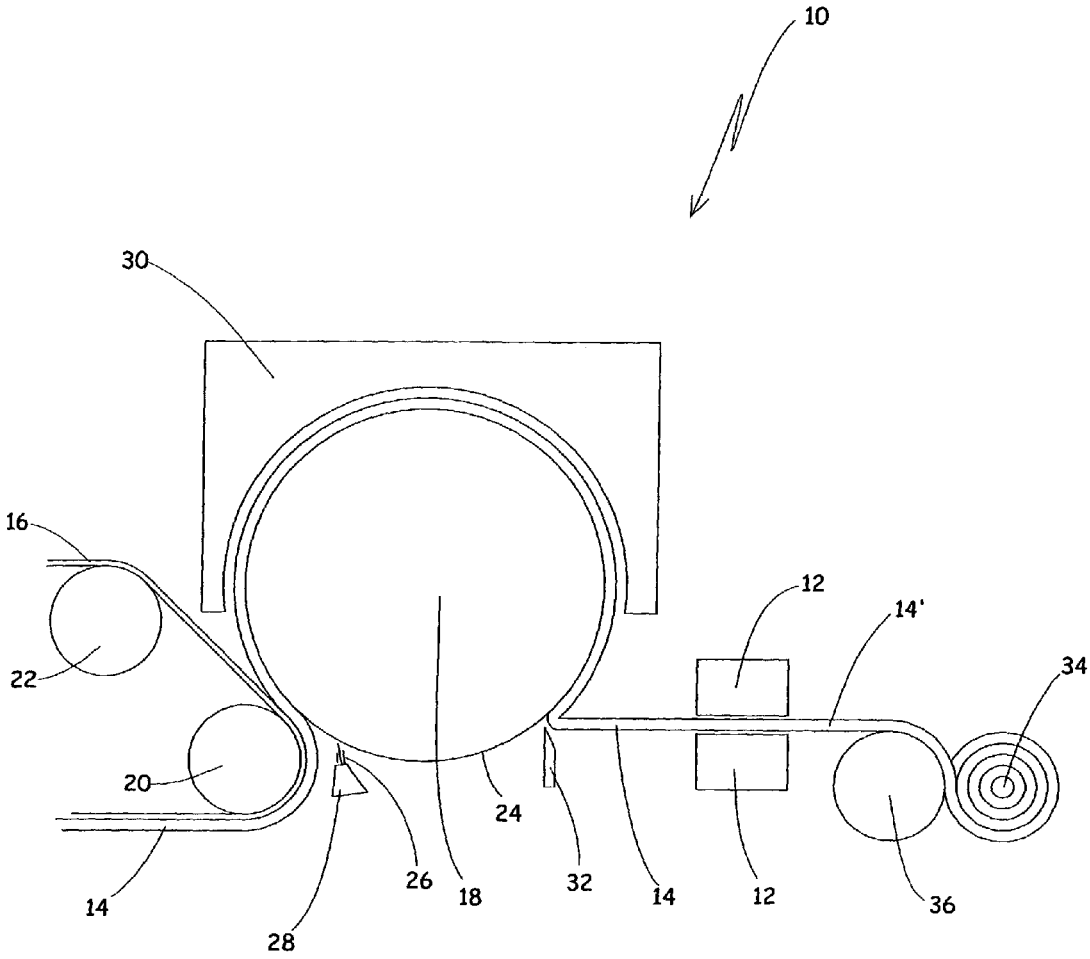
FIG. 1 is a schematic representation of a method in accordance with the present invention.

The fibrous structures of the present invention are useful in paper, especially sanitary tissue paper products including, but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 g/m$^2$ and about 120 g/m$^2$, and density of about 0.60 g/cc or less. Preferably, the basis weight will be below about 35 g/m$^2$; and the density will be about 0.30 g/cc or less. Most preferably, the density will be between about 0.04 g/cc and about 0.20 g/cc as measured by the Basis Weight Method described herein.

The fibrous structure of the present invention and/or sanitary tissue product comprising the fibrous structure of the present invention may have a lint value of greater than about 1 and/or greater than about 2 and/or greater than about 3 up to a lint value that is acceptable to a consumer, typically to a point wherein the consumer cannot handle the fibrous structure and/or sanitary tissue product without creating significant lint, as measured by the Lint Method described herein.

The fibrous structure of the present invention may be moving at a speed of greater than about 100 m/min and/or greater than about 300 m/min and/or greater than about 500 m/min when the chemical additive is applied thereto.

The fibrous structure may be made with a fibrous furnish that produces a single layer embryonic fibrous web or a fibrous furnish that produces a multi-layer embryonic fibrous web.

One or more short fibers may be present in a fibrous furnish with one or more long fibers.

Further, one or more short fibers may be present in a furnish layer with one or more long fibers.

The fibrous structures of the present invention and/or paper products comprising such fibrous structures may have a total dry tensile of greater than about 150 g/in and/or from about 200 g/in to about 1000 g/in and/or from about 250 g/in to about 850 g/in as measured by the Total Dry Tensile Method described herein.

The fibrous structures of the present invention and/or paper products comprising such fibrous structures may have a total wet tensile strength of greater than about 25 g/in and/or from about 30 g/in to about 200 g/in and/or from about 150 g/in to about 500 g/in as measured by the Total Wet Tensile Strength Method described herein. Wet strength can be provided by adding permanent wet strength or temporary wet strength resins as is well known in the art.

Treating Composition

The treating composition of the present invention comprises a chemical additive and optionally, a vehicle, an electrolyte, a stabilizer and/or a process aid.

Chemical Additive

The chemical additive of the present invention may include any chemical ingredient that provides a benefit to a fibrous structure when it is applied to and/or incorporated into the fibrous structure.

In one embodiment, the chemical additive is in a liquid form.

In another embodiment, the chemical additive is in a liquid form having a viscosity of greater than about 10 cP and/or 30 cP and/or 50 cP as measured by the Viscosity Method described herein.

In another embodiment, the chemical additive is in a liquid form having a viscosity of less than about 5000 cP.

In yet another embodiment, the chemical additive in liquid form comprising droplets having an average droplet major dimension of from about 5 microns to about 500 microns.

Suitable chemical additives include, but are not limited to, chemical softeners. As used herein, the term "chemical softener" and/or "chemical softening agent" refers to any chemical ingredient, which improves the tactile sensation perceived by the user whom holds a particular paper product and rubs it across her skin. Although somewhat desirable for towel products, softness is a particularly important property for facial and toilet tissues. Such tactile perceivable softness can be characterized by, but is not limited to, friction, flexibility, and smoothness, as well as subjective descriptors, such as a feeling like lubricious, velvet, silk or flannel.

A chemical softening agent is any chemical ingredient, which imparts a lubricious feel to tissue. This includes, for exemplary purposes only, basic waxes such as paraffin and beeswax and oils such as mineral oil and silicone oils and silicone gels as well as petrolatum and more complex lubricants and emollients such as quaternary ammonium compounds with long ($C_{10}$-$C_{22}$) hydrocarbyl chains, functional silicones, and long ($C_{10}$-$C_{22}$) hydrocarbyl chain-bearing compounds possessing functional groups such as amines, acids, alcohols and esters.

Particularly preferred chemical softening agents are further detailed as follows:

i. Quaternary Ammonium Softeners

Preferably, quaternary ammonium compounds suitable to serve as chemical softening agents of the present invention have the formula:

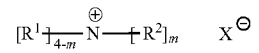

wherein:

m is 1 to 3; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

Preferably, each $R^1$ is methyl and $X^-$ is chloride or methyl sulfate. Preferably, each $R^2$ is independently $C_{16}$-$C_{18}$ alkyl or alkenyl, most preferably each $R^2$ is independently straight-chain $C_{18}$ alkyl or alkenyl.

Particularly preferred variants of these softening agents are what are considered to be mono or diester variations of these quaternary ammonium compounds having the formula:

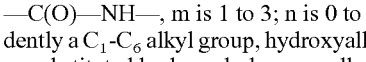

wherein:

Y is —O—(O)C—, or —C(O)—O—, or —NH—C(O)—, or —C(O)—NH—, m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, or mixtures thereof, each $R^3$ is independently a $C_{13}$-$C_{21}$ alkyl group, hydroxyalkyl group, hydrocarbyl or substituted hydrocarbyl group, alkoxylated group, benzyl group, or mixtures thereof, and $X^-$ is any softener-compatible anion.

Preferably, Y is —O—(O)C—, or —C(O)—O—; m=2; and n=2. Each $R^1$ is independently preferably a $C_1$-$C_3$, alkyl group, with methyl being most preferred. Preferably, each $R^3$ is independently $C_{13}$-$C_{17}$ alkyl and/or alkenyl, more preferably $R^3$ is independently straight chain $C_{15}$-$C_{17}$ alkyl and/or alkenyl, $C_{15}$-$C_{17}$ alkyl, most preferably each $R^3$ is independently straight-chain $C_{17}$ alkyl.

As mentioned above, $X^-$ can be any softener-compatible anion, for example, acetate, chloride, bromide, methyl sulfate, formate, sulfate, nitrate and the like can also be used in the present invention. Preferably $X^-$ is chloride or methyl sulfate.

One particularly preferred material is so-called DEEDMAMS (diethyl ester dimethyl ammonium methyl sulfate), further defined herein wherein the hydrocarbyl chains are derived from tallow fatty acids optionally partially hardened to an iodine value from about 10 to about 60.

ii. Emollient Lotion Composition

Suitable chemical softening agents as defined herein may include emollient lotion compositions. As used herein, an "emollient lotion composition" is a chemical softening agent that softens, soothes, supples, coats, lubricates, or moisturizes the skin. An emollient typically accomplishes several of these objectives such as soothing, moisturizing, and lubricating the skin.

Emollients useful in the present invention can be petroleum-based, fatty acid ester type, alkyl ethoxylate type, or mixtures of these emollients. Suitable petroleum-based emollients include those hydrocarbons, or mixtures of hydrocarbons, having chain lengths of from 16 to 32 carbon atoms. Petroleum based hydrocarbons having these chain lengths include mineral oil (also known as "liquid petrolatum") and petrolatum (also known as "mineral wax," "petroleum jelly" and "mineral jelly"). Mineral oil usually refers to less viscous mixtures of hydrocarbons having from 16 to 20 carbon atoms. Petrolatum usually refers to more viscous mixtures of hydrocarbons having from 16 to 32 carbon atoms. Petrolatum is a particularly preferred emollient for use in fibrous structures that are incorporated into toilet tissue products and a suitable material is available from Witco, Corp., Greenwich, Conn. as White Protopet® IS. Mineral oil is also a preferred emollient for use in fibrous structures that are incorporated into facial tissue products. Such mineral oil is commercially available also from Witco Corp.

Suitable fatty acid ester type emollients include those derived from $C_{12}$-$C_{28}$ fatty acids, preferably $C_{16}$-$C_{22}$ saturated fatty acids, and short chain ($C_1$-$C_8$, preferably $C_1$-$C_3$) monohydric alcohols. Representative examples of such esters include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$, preferably $C_{12}$-$C_{16}$) and shorter chain fatty acids e.g., lactic acid, such as lauryl lactate and cetyl lactate.

Suitable alkyl ethoxylate type emollients include $C_{12}$-$C_{18}$ fatty alcohol ethoxylates having an average of from 3 to 30 oxyethylene units, preferably from about 4 to about 23. Representative examples of such alkyl ethoxylates include laureth-3 (a lauryl ethoxylate having an average of 3 oxyethylene units), laureth-23 (a lauryl ethoxylate having an average of 23 oxyethylene units), ceteth-10 (acetyl ethoxylate having an average of 10 oxyethylene units) and steareth-10 (a stearyl ethoxylate having an average of 10 oxyethylene units). These alkyl ethoxylate emollients are typically used in combination with the petroleum-based emollients, such as petrolatum, at a weight ratio of alkyl ethoxylate emollient to petroleum-based emollient of from about 1:1 to about 1:3, preferably from about 1:1.5 to about 1:2.5.

Emollient lotion compositions may optionally include an "immobilizing agents", so-called because it is believed to act to prevent migration of the emollient so that it can remain primarily on the surface of the paper structure to which it is applied so that it may deliver maximum softening benefit as well as be available for transferability to the users skin. Suitable immobilizing agents for the present invention can comprise polyhydroxy fatty acid esters, polyhydroxy fatty acid amides, and mixtures thereof. To be useful as immobilizing agents, the polyhydroxy moiety of the ester or amide has to have at least two free hydroxy groups. It is believed that these free hydroxy groups are the ones that co-crosslink through hydrogen bonds with the cellulosic fibers of the tissue paper web to which the lotion composition is applied and homo-crosslink, also through hydrogen bonds, the hydroxy groups of the ester or amide, thus entrapping and immobilizing the other components in the lotion matrix. Preferred esters and amides will have three or more free hydroxy groups on the polyhydroxy moiety and are typically nonionic in character. Because of the skin sensitivity of those using paper products to which the lotion composition is applied, these esters and amides should also be relatively mild and non-irritating to the skin.

Suitable polyhydroxy fatty acid esters for use in the present invention will have the formula:

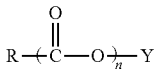

wherein R is a $C_5$-$C_3$, hydrocarbyl group, preferably straight chain $C_7$-$C_{19}$ alkyl or alkenyl, more preferably straight chain $C_9$-$C_{17}$ alkyl or alkenyl, most preferably straight chain $C_{11}$-$C_{17}$ alkyl or alkenyl, or mixture thereof; Y is a polyhydroxyhydrocarbyl moiety having a hydrocarbyl chain with at least 2 free hydroxyls directly connected to the chain; and n is at least 1. Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan.

One class of suitable polyhydroxy fatty acid esters for use in the present invention comprises certain sorbitan esters, preferably the sorbitan esters of $C_{16}$-$C_{22}$ saturated fatty acids. Because of the manner in which they are typically manufactured, these sorbitan esters usually comprise mixtures of mono-, di-, tri-, etc. esters. Representative examples of suitable sorbitan esters include sorbitan palmitates (e.g., SPAN 40), sorbitan stearates (e.g., SPAN 60), and sorbitan behenates, that comprise one or more of the mono-, di- and tri-ester versions of these sorbitan esters, e.g., sorbitan mono-, di- and tri-palmitate, sorbitan mono-, di- and tri-stearate, sorbitan mono-, di and ri-behenate, as well as mixed tallow fatty acid sorbitan mono-, di- and tri-esters. Mixtures of different sorbitan esters can also be used, such as sorbitan palmitates with sorbitan stearates. Particularly preferred sorbitan esters are the sorbitan stearates, typically as a mixture of mono-, di- and tri-esters (plus some tetraester) such as SPAN 60, and sorbitan stearates sold under the trade name GLYCOMUL-S by Lonza, Inc. Although these sorbitan esters typically contain mixtures of mono-, di- and tri-esters, plus some tetraester, the mono- and di-esters are usually the predominant species in these mixtures.

iii. Polysiloxanes and/or Other Silicone Materials

Other suitable chemical softening agents suitable for use in the present invention include silicone materials, such as polysiloxane compounds, cationic silicones, quaternary silicone compounds and/or aminosilicones. In general, suitable polysiloxane materials for use in the present invention include those having monomeric siloxane units of the following structure:

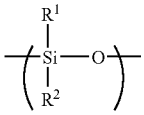

wherein, $R^1$ and R2, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R^1$ and $R^2$ radicals of any particular monomeric unit may differ from the corresponding functionalities of the next adjoining monomeric unit. Additionally, the polysiloxane can be either a straight chain, a branched chain or have a cyclic structure. The radicals $R^1$ and $R^2$ can additionally independently be other silaceous functionalities such as, but not limited to siloxanes, polysiloxanes, silanes, and polysilanes. The radicals $R^1$ and $R^2$ may contain any of a variety of organic functionalities including, for example, alcohol, carboxylic acid, phenyl, and amine functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary aralkyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotloyl, hexafluoroxylyl, and the like.

Preferred polysiloxanes include straight chain organopolysiloxane materials of the following general formula:

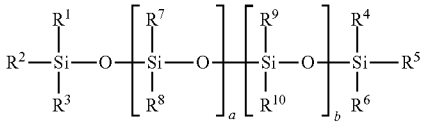

wherein each $R^1$-$R^9$ radical can independently be any $C_1$-$C_{10}$ unsubstituted alkyl or aryl radical, and $R^{10}$ of any substituted $C_1$-$C_{10}$ alkyl or aryl radical. Preferably each $R^1$-$R^9$ radical is independently any $C_1$-$C_4$ unsubstituted alkyl group, those skilled in the art will recognize that technically there is no difference whether, for example, $R^9$ or $R^{10}$ is the substituted radical. Preferably the mole ratio of b to (a+b) is between 0 and about 20%, more preferably between 0 and about 10%, and most preferably between about 1% and about 5%.

In one particularly preferred embodiment, $R^1$-$R^9$ are methyl groups and $R^{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R^{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R^{10}$ could be an amino functional or an aminoalkyl-functional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane can be rendered into a form which can be applied to the tissue paper product herein. This includes, but is not limited to, viscosity as low as about 25 centistokes to about 20,000,000 centistokes or even higher.

While not wishing to be bound by theory, it is believed that the tactile benefit efficacy is related to weight average molecular weight and that viscosity is also related to weight average molecular weight. Accordingly, due to the difficulty of measuring molecular weight directly, viscosity is used herein as the apparent operative parameter with respect to imparting softness to tissue paper.

Optional Ingredients a. Vehicle

As used herein a "vehicle" is a material that can be used to dilute the chemical additive of the treating composition to form a dispersion of the chemical additive within the treating composition. A vehicle may dissolve a chemical additive (true solution or micellar solution) or a chemical additive may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

For purposes of the present invention, one purpose that the vehicle can serve is to dilute the concentration of a chemical additive within a treating composition so that the chemical additive may be efficiently and economically applied to a fibrous structure. For example, as is discussed below, one way of applying such active ingredients is to spray them onto a roll which then transfers the chemical additive to a moving fibrous structure. Typically, only very low levels (e.g. on the order of 2% by weight of the associated tissue) of chemical additive are required to effectively impart a desired benefit, such as tactile softness, to a fibrous structure. This means very accurate metering and spraying systems would be required to distribute a "pure" chemical additive across the full width of a commercial-scale tissue web.

Another purpose of the vehicle can be to deliver the chemical additive in a form in which it is less prone to be mobile with regard to the fibrous structure. Specifically, it is desired to apply the treating composition of the present invention so that the chemical additive of the treating composition resides primarily on the surface of the fibrous structure with minimal absorption into the interior of the fibrous structure. While not wishing to be bound by theory, it is believed that the interaction of the chemical additive with preferred vehicles creates a suspended particle which binds more quickly and permanently than if the chemical additive was applied without the vehicle. For example, it is believed that suspensions of quaternary softeners in water assume a micellar form, which can be substantively deposited onto the surface of the fibers present at the surface of the fibrous structure. Quaternary softeners applied without the aid of the vehicle, i.e. applied in molten form by contrast tend to wick into the interior of the fibrous structure rather than reside on the exterior surface of the fibrous structure. By migrating to the interior of the fibrous structure, the benefit, such as tactile softness, is negatively impacted.

In one embodiment of the present invention, a chemical additive can be dissolved in a vehicle to form a solution. Preferably, the vehicle is compatible with the chemical additive and with the fibrous structure on which the chemical additive is to be deposited. Further a suitable vehicle should not contain any ingredients that create safety issues (either in the tissue manufacturing process or to users of tissue products treated with the chemical additive) and not create an unacceptable risk to the environment.

Suitable materials for use as the vehicle of the present invention include hydroxyl functional liquids, most preferably water.

b. Electrolyte

In addition to a vehicle, the treating composition may also comprise an electrolyte. The electrolyte may be associated with the vehicle. Any electrolyte meeting the general criteria described above for materials suitable for use in the vehicle of the present invention and which is effective in reducing the viscosity of a dispersion of a chemical additive in water is suitable for use in the treating composition of the present invention. In particular, any of the known water-soluble electrolytes meeting the above criteria can be included in the treating composition of the present invention.

When present, the electrolyte can be used in amounts up to about 25% by weight of the treating composition, but preferably no more than about 15% by weight of the treating composition. Preferably, the level of electrolyte is between about 0.1% and about 10% by weight of the treating composition based on the anhydrous weight of the electrolyte. Still more preferably, the electrolyte is used at a level of between about 0.3% and about 1.0% by weight of the treating composition. The minimum amount of the electrolyte will be that amount sufficient to provide the desired viscosity. The dispersions typically display a non-Newtonian rheology, and are shear thinning with a desired viscosity generally ranging from about 50 centipoise (cp) up to about 5000 cp, preferably in the range between about 100 and about 500 cp, as measured at 25° C. and at a shear rate of 100 $sec^{-1}$ using the method described in the Viscosity Method described herein.

Nonlimiting examples of suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. If desired, compatible blends of the various electrolytes are also suitable.

The treating composition may also comprise minor ingredients, which may be associated with the vehicle, such as mineral acids and/or buffer systems for pH adjustment (may be required to maintain hydrolytic stability for certain chemical additives) and antifoam ingredients (e.g., a silicone emulsion as is available from Dow Corning, Corp. of Midland, Mich. as Dow Corning 2310) as a processing aid to reduce foaming when the treating composition of the present invention is applied to a fibrous structure.

c. Stabilizers

Stabilizers may also be used in the treating compositions of the present invention to improve the uniformity and shelf life of the dispersion. For example, an ethoxylated polyester, such as HOE S 4060®, available from Clariant Corporation of Charlotte, N.C. may be included for this purpose.

d. Process Aids

Process aids may also be used in the treating compositions of the present invention. Nonlimiting examples of suitable process aids include brighteners, such as TINOPAL CBS-X®, obtainable from CIBA-GEIGY of Greensboro, N.C.

Forming the Chemical Additive Composition

As noted above, the treating composition of the present invention can be a dispersion of a chemical additive in a vehicle. The vehicle may include an electrolyte and/or stabilizer and/or process aid and/or pH adjusting agent and/or antifoam agents. Depending on the chemical additive, the desired application level and other factors as may require a particular level of chemical additive in the treating composition, the level of chemical additive may vary between about 10% of the treating composition and about 60% of the treating composition. Preferably, the chemical additive comprises between about 20% and about 50% of the treating composition. Most preferably, the chemical additive comprises about 45% of the treating composition. Depending on the method used to produce the treating composition of the present invention, a plasticizer, typically at a level of between about 2% and about 20%, preferably about 15% by weight of the treating composition may be present in the treating composition. As noted above, the preferred primary component of the vehicle is water.

Application Methods

The present invention provides methods for treating a fibrous structure in need of treatment. The method comprises contacting the fibrous structure with a treating composition comprising a chemical additive.

FIG. 1 schematically represents a fibrous structure making method 10 that is suitable for applying a treating composition comprising a chemical additive (not shown) by an application method in accordance with the present invention 12 to a fibrous structure 14. The fibrous structure 14 can be formed by any suitable fibrous structure forming process known in the art, including but not limited to conventional papermaking processes and/or through-air dried papermaking processes. The fibrous structure 14 is carried via a carrier fabric 16 to a cylindrical dryer 18, such as a Yankee dryer, at which point the fibrous structure 14 can be transferred to the cylindrical dryer 18. A pressure roll 20 may be used to aid the transfer to the cylindrical dryer 18 while the transfer fabric 16 travels past a turning roll 22. In one embodiment, the surface 24 of the cylindrical dryer 18 may have an adhesive 26 applied to it via an adhesive source, such as a spray applicator 28. The cylindrical dryer 18 may be heated, such as steam-heated, to facilitate drying of the fibrous structure 14 as the fibrous structure 14 is in direct and/or indirect contact with the surface 24 of the cylindrical dryer 18. Heated air may also be applied to the fibrous structure 14 via a heated air source, such as a drying hood 30. The fibrous structure 14 may then be transferred from the cylindrical dryer 18. A creping operation utilizing a creping blade 32 may be used to remove the fibrous structure 14 from the cylindrical dryer 18. Once the fibrous structure 14 has been removed from the cylindrical dryer 18, the fibrous structure 14 is then treated with a chemical additive (not shown) via the application method 12. One or both sides of the fibrous structure 14 may be treated with the chemical additive. Once the fibrous structure 14 has been treated with the chemical additive via the application method 12, the treated fibrous structure 14' can then be wound onto a parent roll 34 by any suitable method known to those of ordinary skill in the art, such as via a reel 36.

Preferably, the treating composition is applied to a dry fibrous structure. The term "dry fibrous structure" as used herein includes both fibrous structures which are dried to a moisture content of less than the equilibrium moisture content thereof (overdried-see below) and fibrous structures which are at a moisture content in equilibrium with atmospheric moisture. A semi-dry fibrous structure includes a fibrous structure with a moisture content exceeding its equilibrium moisture content.

As used herein, the term "hot fibrous structure" refers to a fibrous structure, which is at an elevated temperature relative to room temperature. Preferably the elevated temperature of the fibrous structure is at least about 43° C., and more preferably at least about 65° C.

The moisture content of a fibrous structure is related to the temperature of the fibrous structure and the relative humidity of the environment in which the fibrous structure is placed. As used herein, the term "overdried fibrous structure" refers to a fibrous structure that is dried to a moisture content less than its equilibrium moisture content at standard test conditions of 23° C. and 50% relative humidity. The equilibrium moisture content of a fibrous structure placed in standard testing conditions of 23° C. and 50% relative humidity is approximately 7%. A fibrous structure of the present invention can be overdried by raising it to an elevated temperature through use of drying means known to the art such as a Yankee dryer or through air drying. Preferably, an overdried fibrous structure will have a moisture content of less than 7%, more preferably from about 0 to about 6%, and most preferably, a moisture content of from about 0 to about 3%, by weight.

Fibrous structure exposed to the normal environment typically has an equilibrium moisture content in the range of 5 to 8%. When a fibrous structure is dried and creped the moisture content in the fibrous structure is generally less than 3%. After manufacturing, the fibrous structure absorbs water from the atmosphere. In a preferred process of the present invention, advantage is taken of the low moisture content in the fibrous structure as it leaves the doctor blade as it is removed from the Yankee dryer (or the low moisture content of similar fibrous structures as such fibrous structures are removed from alternate drying means if the process does not involve a Yankee dryer).

In one embodiment, the treating composition of the present invention is applied to an overdried fibrous structure shortly after it is separated from a drying means and before it is wound onto a parent roll.

Alternatively, the treating composition of the present invention may be applied to a semi-dry fibrous structure, for example while the fibrous structure is on the Fourdrinier cloth, on a drying felt or fabric, or while the fibrous structure is in contact with the Yankee dryer or other alternative drying, means.

Finally, the treating composition can also be applied to a dry fibrous structure in moisture equilibrium with its environment as the fibrous structure is unwound from a parent roll as for example during an off-line converting operation.

In another embodiment, the treating composition of the present invention may be applied after the fibrous structure has been dried and creped, and, more preferably, while the fibrous structure is still at an elevated temperature. Preferably, the treating composition is applied to the dried and creped fibrous structure before the fibrous structure is wound onto the parent roll.

The chemical additive via the treating composition can be added to either side of the fibrous structure singularly, or to both sides; preferably, the chemical additive is applied to only one side of the fibrous structure; the side of the fibrous structure with raised regions, which will later be orientated toward the exterior surface of the sanitary tissue paper product. Suitably the present invention is useful to apply a treating composition to a fibrous structure at a level of at least about 0.1% and/or at least about 0.3% and/or at least about 0.5% by weight of the fibrous structure.

In one embodiment, in order to prevent the soft sanitary tissue paper product of the present invention from having an unacceptable (to some users) greasy feel, the treating composition can be added to the fibrous structure at a level of less than about 8%, preferably less than about 5%, more preferably less than about 3% by weight of the fibrous structure.

Alternatively, effective amounts of chemical additive via the treating compositions of the present invention may also be applied to a fibrous structure that has cooled after initial drying and has come into moisture equilibrium with its environment. The method of applying the treating compositions of the present invention is substantially the same as that described above for application of such compositions to a hot and/or overdried fibrous structure.

1) Transfer Surface Application (i.e., by Means of Calender Rolls and/or Turning Rolls and/or Spreading Rolls and/or Yankee Dryers)

Figure 2:
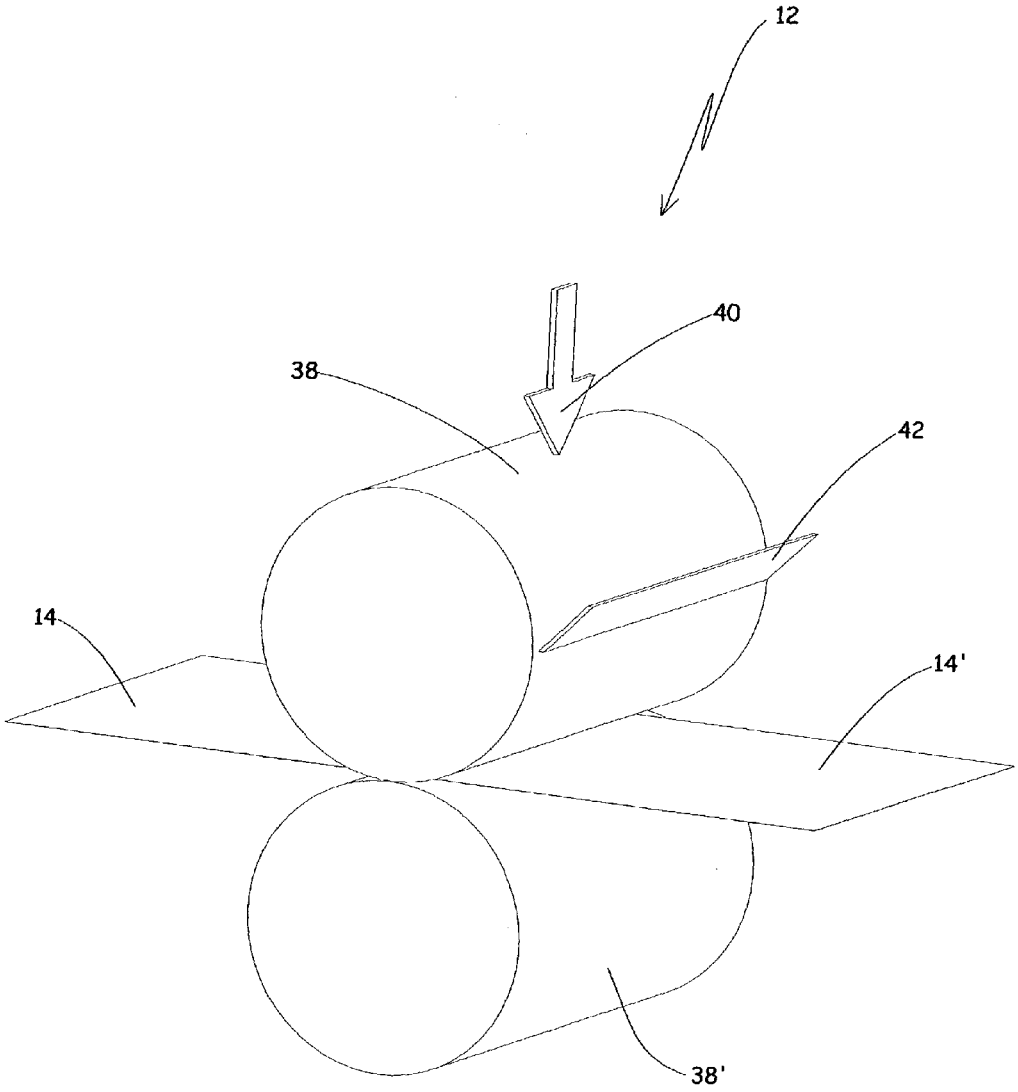
FIG. 2 is a schematic representation of a transfer surface method embodiment of the present invention.

As represented in FIG. 2, the application method 12 of FIG. 1 may comprise applying the treating composition comprising a chemical additive to a surface of a fibrous structure 14 using a transfer surface 38, such as a calender roll and/or a cylindrical dryer, turning rolls, or spreading rolls (not shown). "Spreader roll(s)" as used herein include rollers designed to apply cross direction stresses in order to smooth moving/traveling fibrous structures for example to remove wrinkles. Nonlimiting examples include bowed rollers commercially available from Stowe Woodward—Mount Hope Company of Westborough, Mass. "Turning roll(s)" as used herein refers to any predominantly straight roller engaging the moving/traveling fibrous structure. Turning rolls include idlers which may be externally driven or they may be driven by the moving/traveling fibrous structure. Externally driven turning rolls are preferred since it is easier to maintain the relative speed difference of the roller surface compared to the fibrous structure as prescribed herein.

A treating composition comprising a chemical additive 40 is applied to the transfer surface 38 by any suitable means known in the art. When the a surface of a fibrous structure 14 contacts the transfer surface 38, the treating composition 40, especially the chemical additive, is transferred from the transfer surface 38 to the surface of the fibrous structure 14 thus producing a treated fibrous structure 14'. Another potential transfer surface, such as another calender roll, such as 38' may be needed depending upon the manner the fibrous structure 14 contacts the transfer roll 38. The additional transfer surface 38' may, but does not have contain the treating composition 40. The transfer surface 38 may comprise a doctor blade 42 such that excess treating composition 40 is removed from the transfer surface 38. Calender roll transfer surface 38 is moving at a different speed than the fibrous structure 14. For example, the calender roll may be moving, such as rotating, at a speed differential compared to the speed of the fibrous structure of at least about 0.3% and/or at least about 0.5% and/or at least about 0.7% and/or at least about 1%.

The transfer surface is normally maintained at a temperature near that of the fibrous structure which is contacting it. Therefore, it is typically at temperature of from about 15° C. (60° F.) to about 82° C. (180° F.).

Preferably, the treating composition is applied to the transfer surface in a macroscopically uniform fashion for subsequent transfer to the fibrous structure so that substantially the entire surface of the fibrous structure benefits from the effect of the treating composition. Following application to the transfer surface, at least a portion of the volatile components of any vehicle preferably evaporates leaving preferably a thin film containing any remaining unevaporated portion of the volatile components of the vehicle, the chemical additive, and other nonvolatile components of the treating composition. By "thin film" it is meant any thin coating, haze or mist on the transfer surface. This thin film can be microscopically continuous or be comprised of discrete elements. If the thin film is comprised of discrete elements, the elements can be of uniform size or varying in size; further they may be arranged in a regular pattern or in an irregular pattern, but macroscopically the thin film is uniform. Preferably the thin film is composed of discrete elements.

Methods of macroscopically uniformly applying the treating composition to the transfer surface include spraying and printing. Spraying has been found to be economical, and can be accurately controlled with respect to quantity and distribution of the treating composition, so it is more preferred. Preferably, the dispersed treating composition is applied from the transfer surface onto the dried, creped fibrous structure after the Yankee dryer and before the parent roll. A particularly convenient means of accomplishing this application is to apply the treating composition to one or both of a pair of heated calender rolls which, in addition to serving as hot transfer surfaces for the present treating composition, also serve to reduce and control the thickness of the dried fibrous structure to the desired caliper of the finished product. Such convenient means are described in greater detail in U.S. Pat. No. 6,162,329.

In one embodiment, the transfer surface may be cleaned by any suitable cleaning method known in the art.

2) Non-Contact (i.e., Spray) Application

Figure 3:
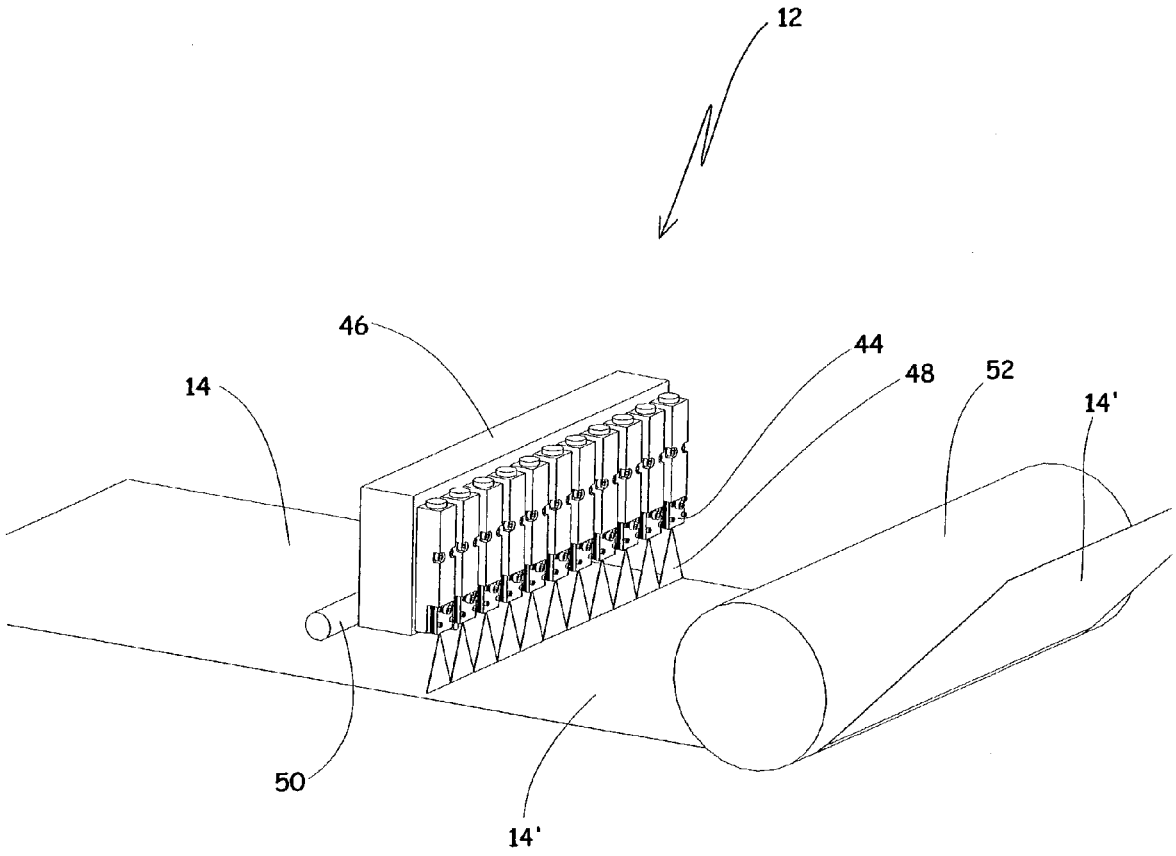
FIG. 3 is a schematic representation of a non-contact applicator method embodiment of the present invention.

As represented in FIG. 3, the application method 12 of FIG. 1 may comprise applying a treating composition comprising a chemical additive using a non-contact applicator, such as nozzles 44, to apply the treating composition onto the surface of the fibrous structure 14 to produce a treated fibrous structure 14'. In addition to a spray application, as illustrated in FIG. 3, the treating composition comprising a chemical additive may also be non-contact applied via a drip and/or curtain (not shown). In FIG. 3, an array of nozzles 44, preferably oscillatory nozzles, are mounted to a chemical additive distribution manifold 46. The chemical additive 48 is applied via at least one nozzle 44 to the surface of the fibrous structure 14 in the form of a spray, preferably an oscillatory spray.

A nozzle cleaning system 50 can be employed to keep the nozzles 44 free from debris, dust and/or residual chemical additive. Further, a post turning roll 52 may optionally be employed on the treated surface of fibrous structure 14' to direct particles, preferably chemical additive particles, that may not be in contact with the surface of the fibrous structure 14', into contact with the surface of the fibrous structure 14'. If optional post turning roll 52 is employed, it is preferably driven at a surface speed differential compared to fibrous structure 14'. Preferably, this surface speed differential greater than 0.1%, more preferably greater than 0.3, and most preferably greater than 0.5%.

Figure 4:
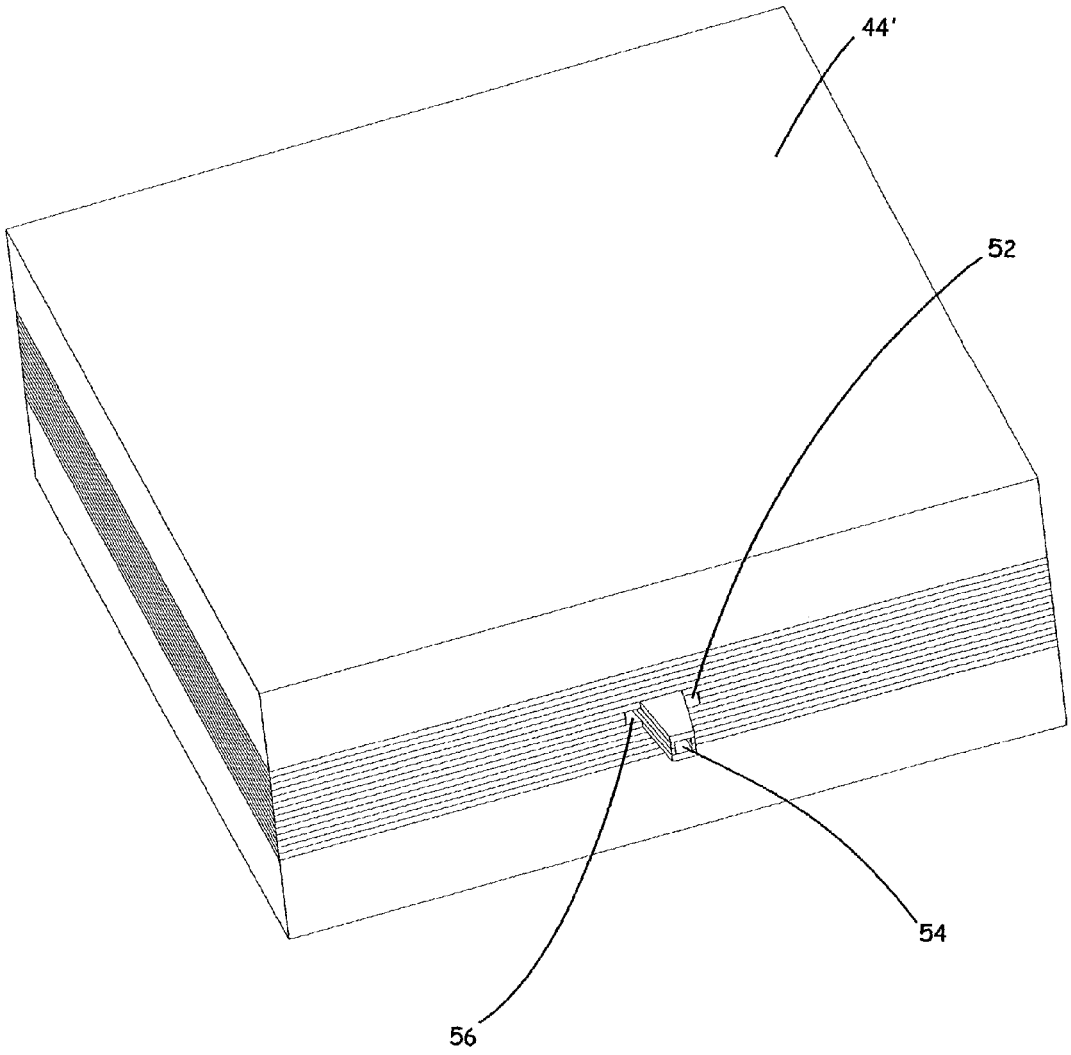
FIG. 4 is a schematic representation of a nozzle suitable for use in a non-contact applicator method embodiment of the present invention.

FIG. 4 schematically represents one embodiment of an oscillatory nozzle 44' having a liquid exit orifice 54 and an air exit orifice 56. Oscillatory nozzle is a termed used herein to refer to a nozzle which promotes an oscillatory motion in the extrudate upon exit from the nozzle. Without being bound by theory, oscillatory flow motion is believed to be the result of alternating forces induced when the fluid flow is flanked on each side by atomizing air jets which are directed generally parallel to the fluid stream. Angle of air stream directed from each of the flanking air exit orifices 56 relative to liquid exit orifice 54 should therefore be limited to no more than about 20°, preferably less than about 10°. Deeper angles tend to prematurely obliterate the fluid jet resulting in creation of an aerosol fraction, which tends to migrate away from the application zone and promote the creation of kgnarr. A nonlimiting example of a suitable nozzle comprising a non-contact applicator is commercially available from Illinois Tool Works Dynatec as part no. 107921.

Figure 5:
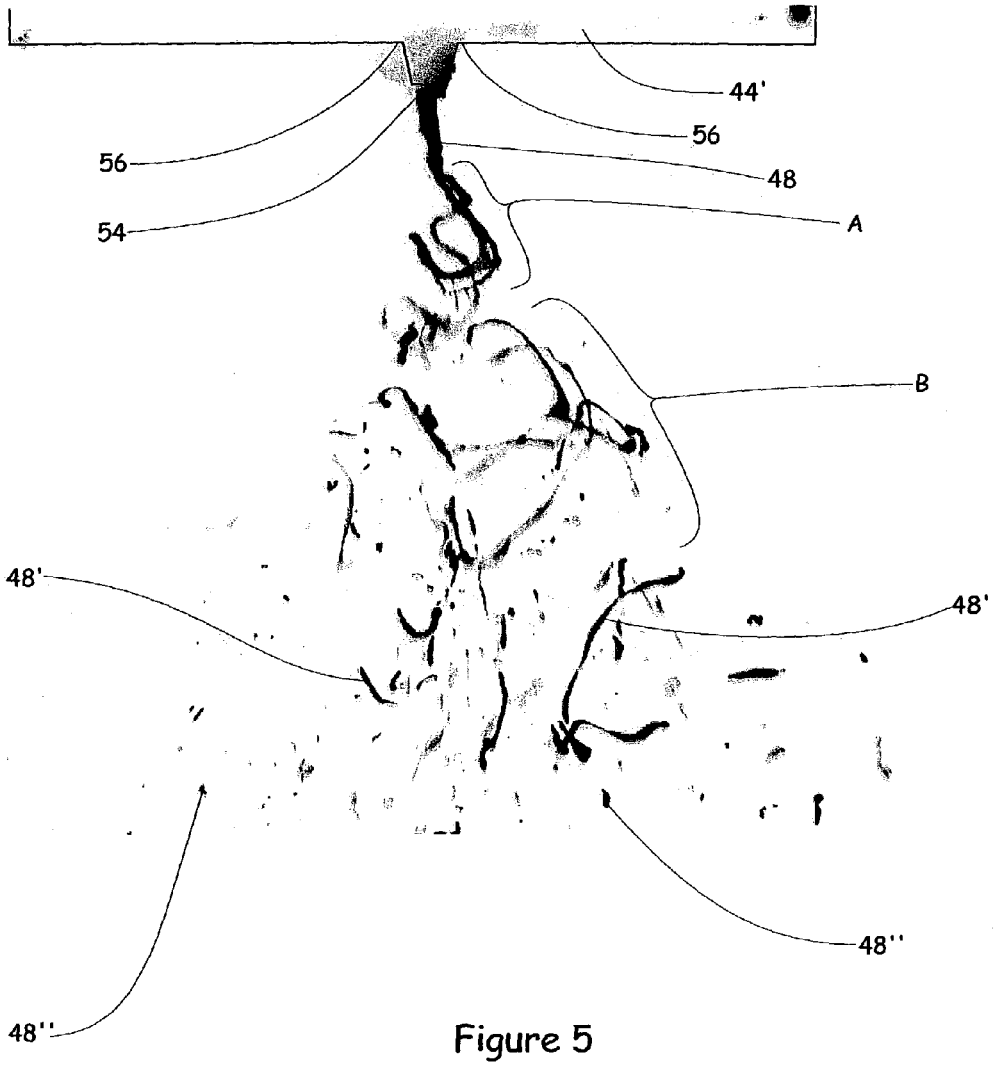
FIG. 5 is a schematic representation of a spray discharge that can be obtained from an oscillatory nozzle of the present invention.

FIG. 5 schematically illustrates one embodiment of a spray produced by an oscillatory nozzle 44'. The chemical additive 48 exits the liquid exit orifice 54 where it is stressed by an air stream that is exiting from the air exit orifice 56. As the chemical additive 48 moves away from the liquid exit orifice 54 it begins to oscillate, represented by zone A. As the amplitude of the oscillation increases, the chemical additive 48 elongates, as represented by zone B. As the chemical additive 48 elongates in zone B, the chemical additive breaks into sections of elongated chemical additive 48'. The elongated chemical additive 48' then begins to contract back to a droplet 48", preferably a spherical-shaped droplet.

Figure 6:
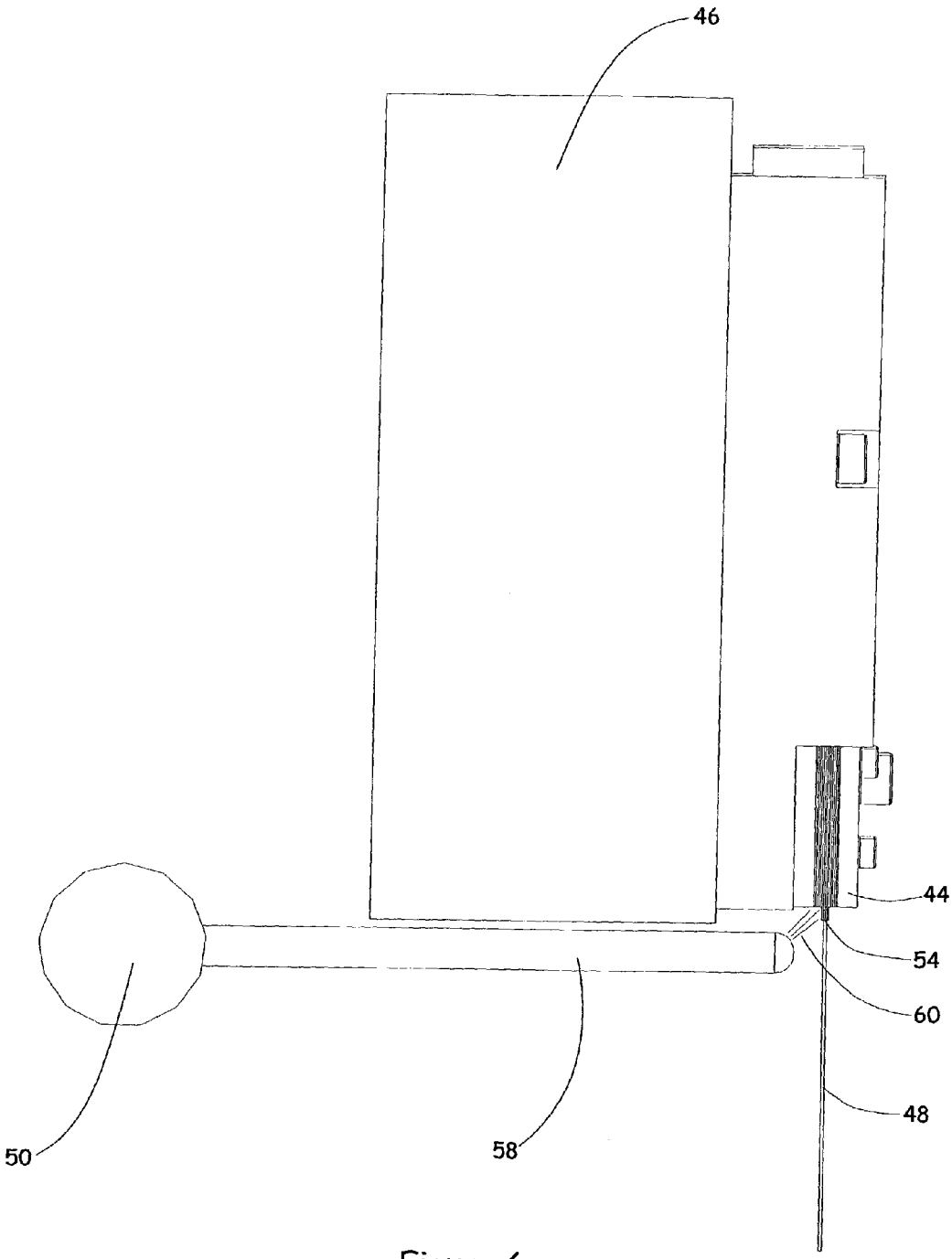
FIG. 6 is a schematic representation of a nozzle cleaning system that can be used with a nozzle of a non-contact applicator method embodiment of the present invention.

An embodiment of a nozzle cleaning system 50 for use with nozzles 44 is represented in FIG. 6. The nozzle cleaning system 50 comprises a traversing cleaning nozzle 58 that when in operation, directs air 60 towards the liquid exit orifice 54 and the air exit orifice 56 of a nozzle 44, preferably each nozzle 44, thus removing any accumulated debris from the exit orifices 54 and 56.

In one embodiment, nozzles 44 are positioned adjacent to the fibrous structure 14' at a separation distance of less than about 10 cm and/or less than about 5 cm and/or less than about 3 cm and/or less than about 1 cm and/or less than about 0.51 cm.

A nonlimiting example of a suitable non-contact applicator is commercially available from Illinois Tool Works.

3) Extrusion Application

Figure 7:
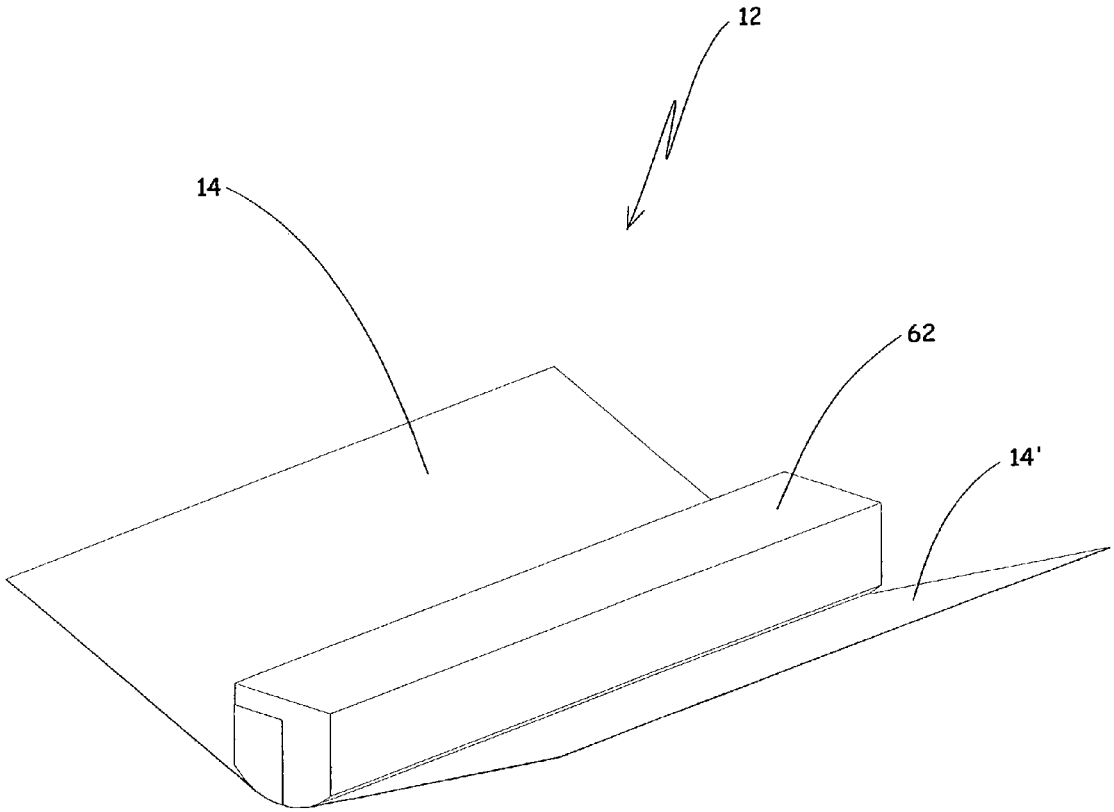
FIG. 7 is a schematic representation of an extrusion application embodiment of the present invention.

As represented in FIG. 7, the application method 12 of FIG. 1 may comprise applying the chemical additive 48 using an extrusion system, such as a slot extrusion die 62. The chemical additive 48 is extruded out of the slot extrusion die 62 onto the surface of the fibrous structure 14 to produce a treated fibrous structure 14'.

Figure 8:
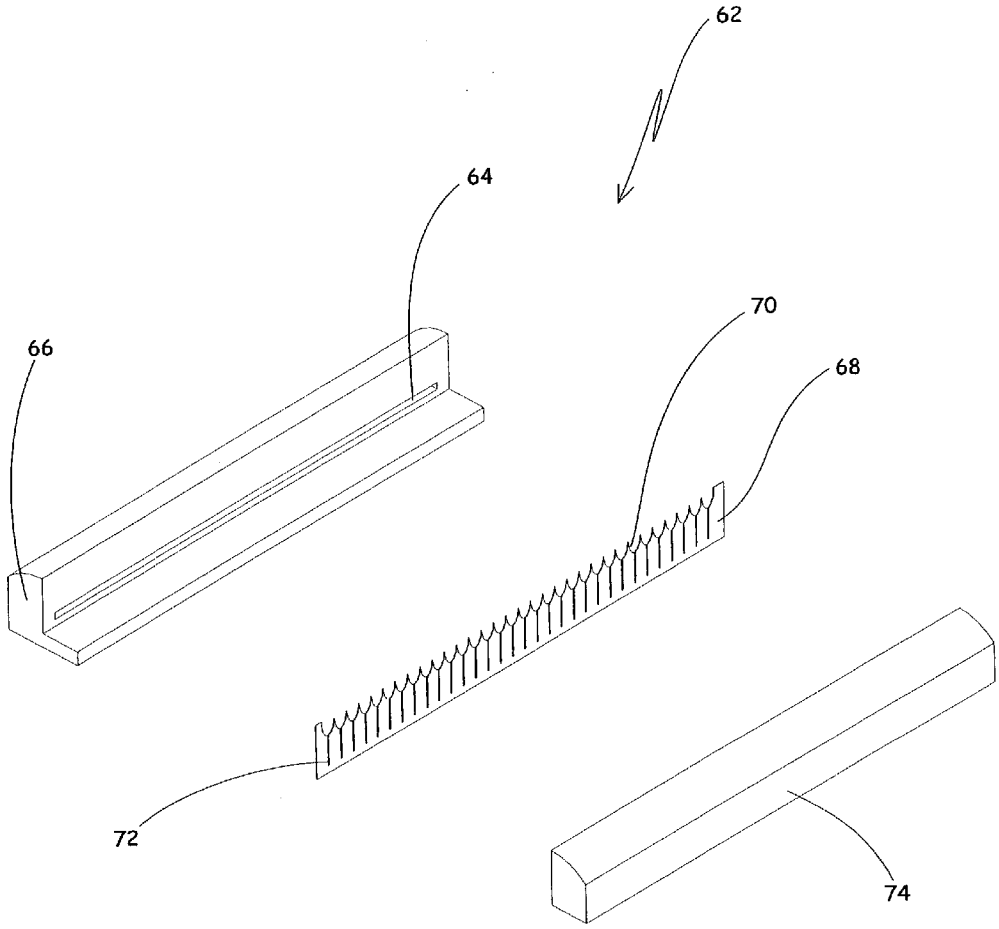
FIG. 8 is an exploded, schematic representation of a slot extrusion die suitable for use in an extrusion application method embodiment of the present invention.

FIG. 8 shows, in an exploded view, an embodiment of a slot extrusion die 62 suitable for use in accordance with the present invention. The chemical additive 48 flows into a chemical additive distribution chamber 64 of a slot extrusion distribution section 66 towards a shim 68. The chemical additive 48 is spread via capillary force at flared ends 70 (discharge surface) of a distribution channel 72 of the shim 68 wherein it then exits the slot extrusion die 62. Slot extrusion lip 74 ensures that the chemical additive 48 exits the slot extrusion die 62 via the flared ends 70 of the distribution channel 72 of the shim 68.

In one embodiment, the discharge surface of the applicator is in contact with the fibrous structure for a distance greater than about 10 cm and/or greater than about 15 cm and/or greater than about 20 cm.

In another embodiment, the discharge surface may be cleaned by any suitable cleaning method known in the art.

Tests Methods

Lint Method:

The amount of lint generated from a fibrous structure is determined with a Sutherland Rub Tester. This tester uses a motor to rub a weighted felt 5 times over the fibrous structure, while the fibrous structure is restrained in a stationary position. This fibrous structure can be is referred to throughout this method as the "web". The Hunter Color L value is measured before and after the rub test. The difference between these two Hunter Color L values is then use to calculate a lint value.

i. Sample Preparation

Prior to the lint rub testing, the samples to be tested should be conditioned according to Tappi Method #T402OM-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 1701). The web is first prepared by removing and discarding any product which might have been abraded in handling, e.g. on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.5".times.6". Puncture two holes into each of the six cards by forcing the cardboard onto the hold down pins of the Sutherland Rub tester.

Center and carefully place each of the 2.5×6" cardboard pieces on top of the six previously folded samples. Make sure the 6" dimension of the cardboard is running parallel to the machine direction (MD) of each of the tissue samples. Center and carefully place each of the cardboard pieces on top of the three previously folded samples. Once again, make sure the 6" dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.25".times.7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25".times.8.5".times.0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single web sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot. Next, rub test the 24 cardboard/felt boards of the new lot and the 24 cardboard/felt boards of the old lot as described below. Make sure the same web lot number is used for each of the 24 samples for the old and new lots. In addition, sampling of the web in the preparation of the cardboard/tissue samples must be done so the new lot of felt and the old lot of felt are exposed to as representative as possible of a tissue sample. Discard any product which might have been damaged or abraded. Next, obtain 48 web samples for the calibration. Place the first sample on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F" (for "first-side") Mark the next highest number with the letter "S" (for second-side). Continue marking the samples in this alternating "F"/"S" pattern. Use the "F" samples for first surface "out" lint analyses and the "S" samples for second-side surface "out" lint analyses. There are now a total of 24 samples for the new lot of felt and the old lot of felt. Of this 24, twelve are for first-side surface "out" lint analysis and 12 are for second-side surface "out" lint analysis.

Rub and measure the Hunter Color L values for all 24 samples of the old felt as described below. Record the 12 first-side surface Hunter Color L values for the old felt. Average the 12 values. Record the 12 second-side surface Hunter Color L values for the old felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first-side surface and the delta average difference for the second-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 first-side surface Hunter Color L values for the new felt. Average the 12 values. Record the 12 second-side surface Hunter Color L values for the new felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first side surface and the delta average difference for the second-side surface and divide this sum by 2. This is the uncorrected lint value for the new felt.

Take the difference between the corrected Lint Value from the old felt and the uncorrected lint value for the new felt. This difference is the felt correction factor for the new lot of felt. Adding this felt correction factor to the uncorrected lint value for the new felt should be identical to the corrected Lint Value for the old felt. Note that the above procedure implies that the calibration is done with a two-surfaced specimen. If it desirable or necessary to do a felt calibration using a single-surfaced sample, it is satisfactory; however, the total of 24 tests should still be done for each felt.

ii. Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

iv. Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test. Prepare a test specimen on cardboard sample as described above. In addition, prepare a felt on cardboard sample as described above. Both of these samples will be used for calibration of the instrument and will not be used in the acquisition of data for the actual samples.

Place this calibration web sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the web sample and not the web sample itself. The felt must rest flat on the tissue sample and must be in 100% contact with the web surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the web sample at the beginning and end of this test, the tester is calibrated and ready to use. If the total number of strokes is not five or if the end of the felt covered weight closest to the operator is over the actual web sample either at the beginning or end of the test, repeat this calibration procedure until 5 strokes are counted the end of the felt covered weight closest to the operator is situated over the cardboard at the both the start and end of the test. During the actual testing of samples, monitor and observe the stroke count and the starting and stopping point of the felt covered weight. Recalibrate when necessary.

v. Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary. Place the white standard plate on the sample stage under the instrument port. Release the sample stage and allow the sample plate to be raised beneath the sample port. Using the "L-Y", "a-X", and "b-Z" standardizing knobs, adjust the instrument to read the Standard White Plate Values of "L", "a", and "b" when the "L", "a", and "b" push buttons are depressed in turn.

vi. Measurement Of Samples

The first step in the measurement of lint is to measure the Hunter color values of the black felt/cardboard samples prior to being rubbed on the web sample. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit. If a D25D2A head is in use, lower the felt covered cardboard and plate, rotate the felt covered cardboard 90° so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual web sample/cardboard combinations, place the web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight Hook this weight onto the tester arm and gently place the web sample underneath the weight/felt combination. The end of the weight closest to the operator must be over the cardboard of the web sample and not the web sample itself. The felt must rest flat on the web sample and must be in 100% contact with the web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the web sample. If torn, discard the felt and web sample and start over. If the web sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

Determine the delta L values by subtracting the average initial L reading found for the unused felts from each of the measured values for the first-side surface and second-side surface sides of the sample as follows.

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Subtract the felt factor from each of these averages. The final results are termed a lint for the first-side surface and a lint for the second-side surface of the web.

By taking the average of the lint value on the first-side surface and the second-side surface, the lint is obtained which is applicable to that particular web or product. In other words, to calculate lint value, the following formula is used:

$$\text{Lint Value} = \frac{\text{Lint Value, first-side} + \text{Lint Value, second-side}}{2}$$

For samples measured only for one surface, subtract the average initial L reading found for the unused felts from each of the three L readings. Calculate the average delta for the three surface values. Subtract the felt factor from this average. The final result is the lint value for that particular web or product.

Viscosity Method:

Viscosity is measured at a shear rate of 100 seconds$^{-1}$ using a Dynamic Stress Rheometer Model SR500, commercially available from Rheometrics Scientific, Inc. of Piscataway, N.J. The samples are subjected to a linear stress sweep, which applies a range of stresses, each at a constant amplitude. Conditions for the viscosity test are: Sample Plates are 25 mm parallel insulated plates; Setup Gap is 0.5 mm; Sample Temperature is the temperature corresponding to the fibrous structure temperature at the point of application of the chemical additive; Sample Volume is at least 0.2455 cm$^3$; Initial Shear Stress is 10 dynes/cm$^2$; Final Shear Stress is 1,000 dynes/cm$^2$; and Stress Increment is 25 dynes/Cm$^2$ applied every 20 seconds.

Density Method:

The density, as that term is used herein, of a fibrous structure in accordance with the present invention and/or a sanitary tissue product comprising a fibrous structure in accordance with the present invention, is the average ("apparent") density calculated as the basis weight of that fibrous structure or sanitary tissue product divided by the caliper, with appropriate unit conversions. Caliper, as used herein, of a fibrous structure and/or sanitary tissue product is the thickness of the fibrous structure or sanitary tissue product comprising such fibrous structure when subjected to a compressive load of 15.5 g/cm$^2$.

Basis Weight Method:

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples (m$^2$). The basis weight (g/m$^2$) is calculated by dividing the average weight (g) by the average area of the samples (m$^2$).

Total Dry Tensile Strength Method:

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

Total Wet Tensile Strength Method:

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a fibrous structure of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus crosshead displacement (centimeters from starting point).

The sample is tested in both MD and CD orientations. The wet tensile strength of a fibrous structure is calculated as follows:

$$\text{Total Wet Tensile Strength}=\text{Peak Load}_{MD}\ (g_f)/2\ (\text{inch}_{width})+\text{Peak Load}_{CD}\ (g_f)/2\ (\text{inch}_{width})$$

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for treating a fibrous structure in need of treatment, the method comprising the steps of:

a. providing a transfer surface selected from the group consisting of a Yankee dryer surface, a calender roll surface, a spreader roll surface, a turning roll surface and mixtures thereof wherein a treating composition comprising a chemical additive comprising a chemical softening agent in the form of a liquid is releasably associated with the transfer surface by spraying the treating composition onto the transfer surface;

b. providing a fibrous structure;

c. contacting the fibrous structure with the transfer surface such that the chemical additive is transferred to the fibrous structure, wherein a speed differential exists between the transfer surface and the fibrous structure.

2. The method according to claim 1 wherein the fibrous structure exhibits a lint value of greater than about 2.

3. The method according to claim 1 wherein the fibrous structure is traveling at a speed of greater than about 500 m/min during the contacting step.

4. The method according to claim 1 wherein the chemical additive exhibits a viscosity greater than about 50 cP.

5. The method according to claim 1 wherein the chemical additive comprises droplets having an average droplet major dimension of from about 5 microns to about 500 microns.

6. The method according to claim 1 wherein the chemical softening agent comprises a quaternary compound.

7. The method according to claim 1 wherein the chemical softening agent has the formula:

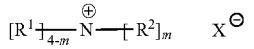

wherein:

m is 1 to 3; each $R_1$ is independently a $C_1$-$C_6$ alkyl group, hydroxyalkyl group, hydrocarbyl or substituted hydrocarbyl group, alkoxylated group, benzyl group and mixtures thereof; each $R_2$ is independently a $C_{14}$-$C_{22}$ alkyl group, hydroxyalkyl group, hydrocarbyl or substituted hydrocarbyl group, alkoxylated group, benzyl group and mixtures thereof; and $X^-$ is any softener compatible anion.

8. The method according to claim 1 wherein the fibrous structure is prepared on a papermaking machine.

9. The method according to claim 1 wherein the speed differential is at least 0.5%.

10. The method according to claim 9 wherein the speed differential is at least 1%.

11. The method according to claim 1 wherein the method further comprises the step of cleaning the transfer surface.

12. A fibrous structure made by the method according to claim 1.

13. A single- or multi-ply sanitary tissue product comprising a fibrous structure according to claim 12.

14. A method for treating a fibrous structure in need of treatment, the method comprising the steps of:

a. providing a transfer surface selected from the group consisting of a Yankee dryer surface, a calender roll surface, a spreader roll surface, a turning roll surface and mixtures thereof wherein a treating composition comprising a chemical additive in the form of a liquid is releasably associated with the transfer surface by printing the treating composition onto the transfer surface;

b. providing a fibrous structure;

c. contacting the fibrous structure with the transfer surface such that the chemical additive is transferred to the fibrous structure, wherein a speed differential exists between the transfer surface and the fibrous structure.

15. The method according to claim 14 wherein the fibrous structure exhibits a lint value of greater than about 2.

16. The method according to claim 14 wherein the fibrous structure is traveling at a speed of greater than about 500 m/min during the contacting step.

17. The method according to claim 14 wherein the chemical additive exhibits a viscosity greater than about 50 cP.

18. The method according to claim 14 wherein the chemical additive comprises droplets having an average droplet major dimension of from about 5 microns to about 500 microns.

19. The method according to claim 14 wherein the fibrous structure is prepared on a papermaking machine.

20. The method according to claim 14 wherein the speed differential is at least 0.5%.

21. The method according to claim 20 wherein the speed differential is at least 1%.

22. The method according to claim 14 wherein the method further comprises the step of cleaning the transfer surface.

23. The method according to claim 14 wherein the chemical additive comprises a chemical softening agent.

24. The method according to claim 14 wherein the chemical softening agent comprises a quaternary compound.

25. The method according to claim 14 wherein the chemical softening agent has the formula:

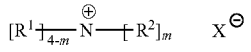

wherein:

m is 1 to 3; each $R_1$ is independently a $C_1$-$C_6$ alkyl group, hydroxyalkyl group, hydrocarbyl or substituted hydrocarbyl group, alkoxylated group, benzyl group and mixtures thereof; each $R_2$ is independently a $C_{14}$-$C_{22}$ alkyl group, hydroxyalkyl group, hydrocarbyl or substituted hydrocarbyl group, alkoxylated group, benzyl group and mixtures thereof; and $X^-$ is any softener compatible anion.

26. A fibrous structure made by the method according to claim 14.

27. A single- or multi-ply sanitary tissue product comprising a fibrous structure according to claim 26.

* * * * *